US005896735A

United States Patent [19]

Wirtz

[11] Patent Number: 5,896,735

[45] Date of Patent: Apr. 27, 1999

[54] METHOD FOR PRODUCING A SPINNING COP IN A POT SPINNING MACHINE

[75] Inventor: Ulrich Wirtz, Mönchengladbach, Germany

[73] Assignee: W. Schlafhorst AG & Co., Germany

[21] Appl. No.: 08/985,039

[22] Filed: Dec. 4, 1997

[30] Foreign Application Priority Data

Dec. 5, 1996 [DE] Germany ..... 196 50 461

[51] Int. Cl.[6] ..... D01H 1/08

[52] U.S. Cl. ..... 57/312; 57/76

[58] Field of Search ..... 57/267, 274, 276, 57/66, 76, 312, 313

[56] References Cited

U.S. PATENT DOCUMENTS 5,289,675 3/1994 Brockmanns et al. .
5,385,007 1/1995 Hartel et al. .

FOREIGN PATENT DOCUMENTS 0 504 614 B1 2/1992 European Pat. Off. .
42 21 676 A1 7/1902 Germany .
41 03 771 A1 2/1991 Germany .
42 08 039 A1 3/1992 Germany .

*Primary Examiner*—John J. Calvert
*Assistant Examiner*—Tejash D Patel
*Attorney, Agent, or Firm*—Kennedy Covington, Lobdell & Hickman, L.L.P.

[57] ABSTRACT

A method of producing a spinning cop in a pot spinning machine includes depositing yarn from a yarn guide onto an upper location of an interior of a spinning pot of the pot spinning machine to form an upper yarn deposit in the upper location; further depositing yarn from the yarn guide onto an area of the interior of the spinning pot spaced from the upper location to form a spinning cake spaced from the upper yarn deposit; and rewinding the spinning cake onto a tube to form a spinning cop and rewinding the upper yarn deposit onto the tube to form a top winding. Yarn forming the upper yarn deposit has a coarser yarn size than the yarn forming the spinning cake. During yarn deposit to form the upper yarn deposit the yarn guide is moved in one direction without traversing movement, and during yarn deposit to form the spinning cake the yarn guide is moved in one direction with traversing movement. Yarn windings are placed in parallel relation in the upper yarn deposit.

13 Claims, 2 Drawing Sheets

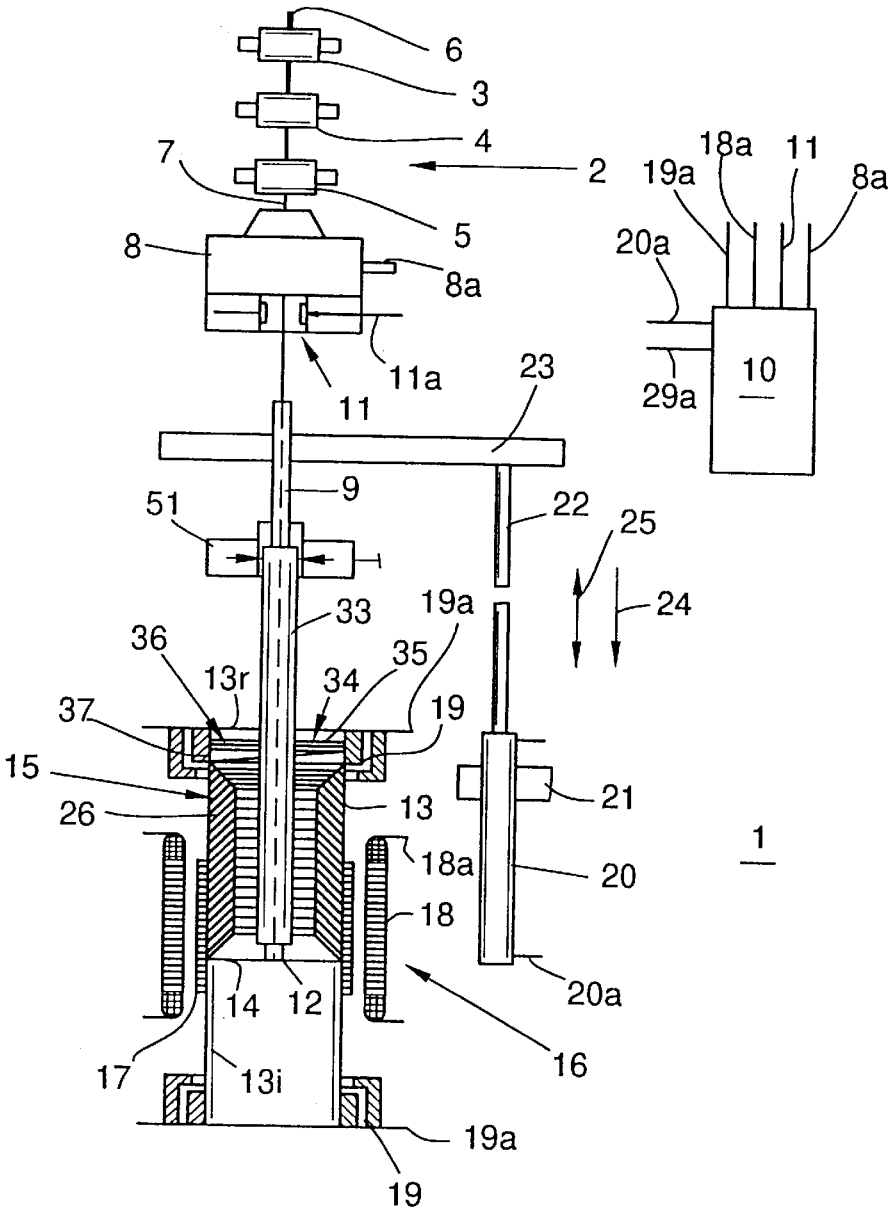
FIG. 1
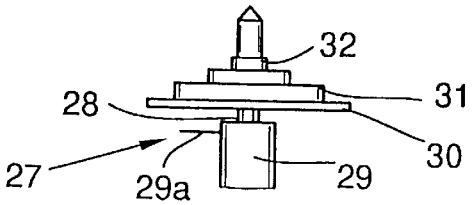

METHOD FOR PRODUCING A SPINNING COP IN A POT SPINNING MACHINE

FIELD OF THE INVENTION

The present invention relates to a method for producing a spinning cop in a pot spinning machine, wherein the spun yarn is placed initially by means of a yarn guide into the interior of a spinning pot in the form of a spinning cake and the spinning cop is subsequently created by rewinding the yarn cake onto a tube.

BACKGROUND OF THE INVENTION

During pot spinning, a so-called spinning cake is first spun in the spinning pot and is then rewound onto an empty tube, so that a spinning cop is created. The outer yarn layer in the pot lies as the lowest layer on the tube after rewinding. After rewinding the free yarn end lies loosely on the yarn body of the cop or on its upper or lower end, depending on where the first yarn deposition within the spinning pot took place at the start of spinning. When rewinding spinning cakes produced in accordance with the method of German Patent Publication DE 41 03 771 A1, the yarn end lies on the yarn body after rewinding. During rewinding of spinning cops produced in one of the pot spinning devices known from European Patent Publication 0 504 615 B1, the yarn end lies on the upper or lower edge of the yarn body after rewinding. Prior to further processing of the spinning cop, it is necessary to search for the yarn end, which requires much time and additional yarn preparation between the spinning and winding processes.

OBJECT AND SUMMARY OF THE INVENTION

It is therefore an object of the instant invention to provide a method by which, during the initial pot spinning operation, the yarn end will be placed so as to be easy to locate later.

This object is attained in accordance with the present invention by an improved method of producing a spinning cop in a pot spinning device, wherein the spun yarn is initially placed by a yarn guide into the interior of a spinning pot in the form of a spinning cake and the spinning cake is subsequently rewound onto a tube to form a spinning cop. Basically, the present invention contemplates that, at the start of spinning in the spinning pot and before the yarn guide begins depositing the yarn to form the spinning cake, the yarn guide is positioned in the spinning pot at an upper location above the area at which the spinning cake will be subsequently deposited and a few windings of the spun yarn are deposited in the upper location for subsequent rewinding as a top winding on the cop tube. Preferably, these windings created prior to the deposit of the spinning cake are placed in parallel relation with each other in the spinning pot. It is further preferred that the yarn for the upper yarn deposit in the spinning pot is formed at a coarser yarn size than the yarn of the spinning cake.

Thus, in accordance with the present invention, at the start of pot spinning a top winding is created for each respective spinning cop which will consist of a few windings on the cop tube above the yarn body. In the course of rewinding the spinning cake onto an empty tube, after the spinning cake has already been wound on the tube, the top winding with the yarn end is placed last on the tube at a defined place above the yarn body. The yarn end is therefore always in the same place on the spinning cop and can be easily detected in this manner.

A further advantage of the present invention lies in that the yarn body has a yarn end which can be reached at a defined place on the cop tube even after a yarn break, since the yarn layers constituting the top winding are first deposited during spinning.

Because of this top winding, it is not necessary to send the spinning cops at a winding station through a preparation station for seeking and depositing the yarn end at a defined place on the tube.

With fine yarns in particular, it can be difficult to pull or blow the top winding away from the tube in a winding station of a winding machine. It is therefore advantageous if the top winding is spun to a coarser yarn size than the yarn of the spinning cake. Since the top winding is cut off prior to the continuation of the winding process, the different yarn number of the top winding poses no disadvantage. In this case, the top winding is easier to handle, in particular to aspirate or blow off. The change in the yarn number (i.e., yarn size) can be achieved at the spinning start by reducing the draft.

Additional features and advantages of the present invention will be explained and understood in more detail by the description of the exemplary embodiments set forth below and with reference to the accompanying drawings.

BRIEF DESCRIPTION OF THE DRAWINGS

FIG. 1 is a schematic elevational view, partially in vertical cross-section, depicting a spinning station in a pot spinning machine according to the present invention;

DETAILED DESCRIPTION OF THE PREFERRED EMBODIMENTS

Figure 2:
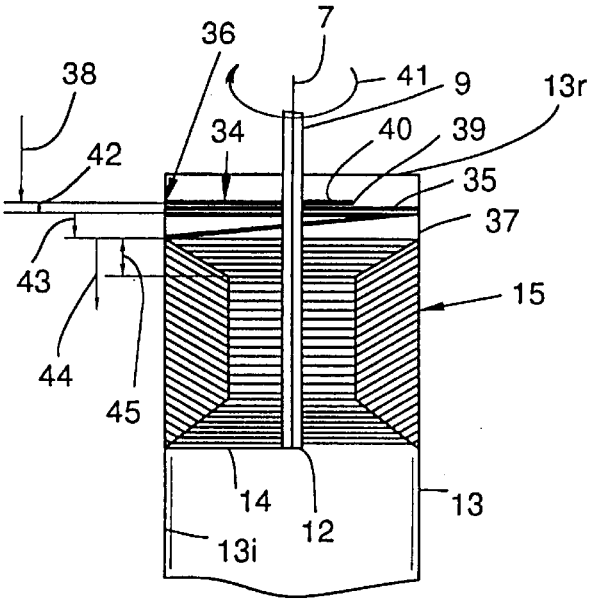
FIG. 2 is a more detailed view similar to FIG. 1 representing the structure of the yarn being deposited for subsequently forming a top winding on a cop with windings leading toward the main yarn body within the spinning pot.
Figure 3:
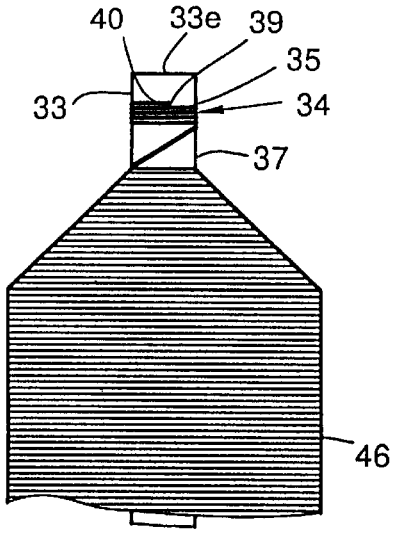
FIG. 3 depicts the structure of a spinning cop whose yarn body has been rewound from a spinning pot in accordance with FIG. 2.

Referring now to the accompanying drawings and initially to FIG. 1, a pot spinning device is schematically identified as a whole by 1. As will be understood, this pot spinning device is only one of several spinning stations in a pot spinning machine. Only the features of the pot spinning device necessary to aid in understanding the present invention have been represented and will be explained.

The pot spinning device 1 for spinning a yarn has a yarn drafting system 2, of which two drafting roller pairs 3 and 4 as well as a pair of delivery rollers 5 are represented by which a sliver 6 is drafted to form a roving 7. To initiate the spinning start, the roving 7 is blown into the yarn guide 9 via a stationary injector 8 having a controllable compressed air connector 8*a*. The control of the pot spinning device 1 is performed by means of a control device 10, which is connected by means of appropriate control and signal lines with the individual units, sensors and motors of the pot spinning device. For example, the delivery of the roving 7 into the yarn guide 9 is monitored by a sensor 11 and reported via the signal line 11*a* of the control device 10, which thereupon initiates the spinning start.

The roving 7 introduced into the yarn guide tube 9 with the aid of the injector 8 exits from the mouth 12 of the yarn guide tube 9 in order to be deposited as a finished twisted yarn 14 on the inner wall 13*i* of the spinning pot 13 in the shape of a spinning cake 15. The spinning pot 13, its seating and its drive correspond to the embodiment of such a device disclosed in German Patent Publication DE 42 08 039 A1. For example, the pot can be made of a carbon fiber-reinforced plastic material and can at the same time be constructed as the rotor of its drive motor 16. To this end, a squirrel-cage rotor 17 is arranged on the circumference of the spinning pot 13. Stator coils 18 of the drive motor 16 enclose the pot 13 at the height of the squirrel-cage rotor 17. The spinning pot 13 is seated at its upper and lower ends by means of magnetic bearings 19 connected via the lines 19*a* with the control device 10, in order to be able to stabilize the position of the spinning pot 13. The seating of the spinning pot as well as its drive are only represented schematically by way of example. They are not a subject of the invention and can also have any other known configuration.

A pneumatic or hydraulic adjusting cylinder 20 is arranged on the machine frame 21 in the present exemplary embodiment as a lifting device for the yarn guide 9, and is connected via a line 20*a* with the control device 10 to extend and retract a piston 22 for moving a yarn guide bed 23 upwardly and downwardly for traversing the yarn guide 9 (and possibly still further yarn guides). This lifting device not only performs the lowering movement 24 for the successive deposition of the windings of the yarn 14, but also a traversing movement 25 in like manner to that of a ring rail of a ring spinning machine for building the layers 26 of the spinning cake 15 into such a form that, after rewinding the spinning cake onto an empty cop tube, a spinning cop in the form of a ring spinning cop is created.

A doffing device 27 is arranged underneath the spinning pot 13 for exchanging a completed spinning cop with an empty cop tube 33. The piston of a hydraulic or pneumatic cylinder 29 oriented in axial alignment with the yarn guide 9 supports a platform 30 on which a disk-shaped support body 31 with an arbor 32 is located. The cylinder 29 can be triggered for lifting and lowering by the control device 10 via a control line 29*a*. In this manner, it is possible to remove from the spinning pot 13 a spinning cop which was created by the rewinding process carried out on the empty bobbin 33 arranged on the yarn guide 9, and to replace the removed cop with a fresh empty bobbin 33. In the process, the empty bobbin 33 newly inserted into the spinning pot is pushed over the yarn guide tube 9 and fixed in place by means of an arresting device 51, which can be actuated in a predefined manner.

The positioning and manipulation of the empty tube for rewinding the spinning cake in the shape represented herein constitutes an exemplary embodiment, but it is to be understood that any other suitable arrangement can be utilized for rewinding the yarn.

The sectional depiction of FIG. 1 longitudinally through the spinning pot 13 not only shows the structure of the spinning cake 15, but also an upper yarn deposit 34 consisting of a few windings 35 of the freshly spun yarn in accordance with the present invention which is provided for forming a top winding on the cop tube. This yarn deposit 34 takes place in an area 36 above the spinning cake 15. The distance 37 between the yarn deposit 34 and the spinning cake 15 is small, in the range of approximately 3 to 5 mm.

The deposition and structure of two different embodiments for making this upper yarn deposit for forming the top winding on the cop tube will be presently explained in more detail with reference to the drawings of FIGS. 2–5. The spinning pot 13 of FIG. 1 is represented in FIG. 2 during the build-up of the spinning cake 15. The few windings 35 of the yarn deposit 34 for forming a top winding on the cop tube are clearly visible. For starting the spinning operation, the mouth 12 of the yarn guide tube 9 is lowered as indicated by the arrow 38 into the area 36 of the spinning pot 13 which is located above the area in which the spinning cake 15 is deposited. Where the tip of the arrow 38 ends, the deposit of the starting end 39 of the yarn, and therefore of the first winding 40 on the inner circumference 13*i* of the spinning pot 13, begins. In an optional feature of the present invention, during the process, the drafting system 2 can be adjusted via the control device 10 in such a way that, by reducing the draft during the production of this top winding, a thicker yarn, i.e., a yarn of a coarser yarn size, is spun than will subsequently be formed in the production of the spinning cake, which yarn size differential is not represented in FIG. 2–5. While the spinning pot 13 rotates in the direction of the arrow 41, two additional yarn windings 35 are deposited as the yarn guide 9 is slowly lowered in the direction of the arrow 42. Thereafter, the yarn guide 9 travels the distance 37 between the top windings 34 and the yarn body 15 by being briskly lowered in the direction of the arrow 43, as indicated by the gap between the yarn windings. Once the mouth 12 of the yarn guide 9 has been lowered by the distance 37, the draft is re-set to the yarn number intended for spinning the yarn, and the build-up of the spinning cake 15 is started by the deposition of yarn layers by traversing movement 45 superimposed on the downward movement 44 of the yarn guide 9, the same as takes place when producing a ring spinning cop.

When a spinning cake built in this way is rewound on an empty tube 33, the cylinder raises an empty tube 33 into the spinning pot and the spinning cake 15 is initially wound as the yarn body 46 onto the tube 33 after which the top winding 34 is wound off last. Thus, the yarn is applied onto the tube 33 in windings 35 which extend away from the yarn body 46 toward the upper tube end 33*e*, whereat the initial winding 40 with the starting end 39 of the yarn from the beginning of the spinning operation lies as the last winding.

It can be clearly seen that a greater number of windings 35 have been placed onto the tube 33 than in the spinning pot 13 because of the lesser diameter of the tube 33 in comparison with the interior diameter of the spinning pot 13. The distance of the windings 35 on the tube 33 from each other has been shown exaggerated in order to make the number of windings clear. In actuality these top windings 35 lie very closely adjacent to each other or even partially on top of each other. Because of their position, these few yarn windings 35 of the top winding 34 can be very easily aspirated off or blown off at the winding station of the spinning machine in order to then be grasped by a gripper tube for winding or yarn end connection.

Figure 4:
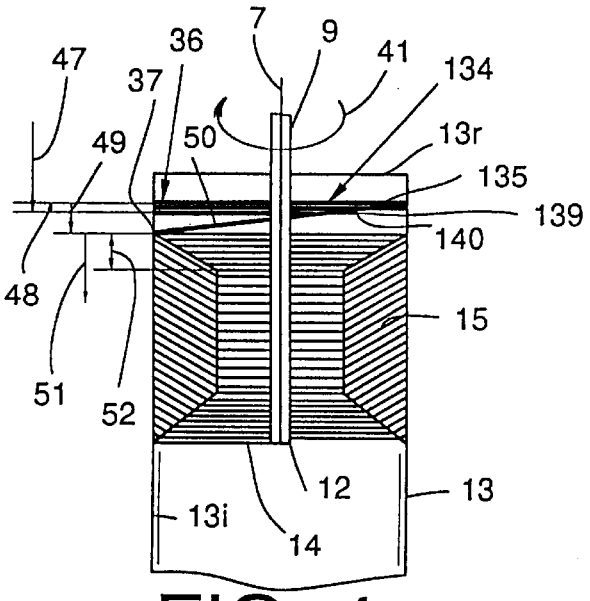
FIG. 4 is a view similar to FIG. 2 showing the structure of a yarn deposited for subsequently forming a top winding on a cop tube with windings leading away from the yarn body within the spinning pot.
Figure 5:
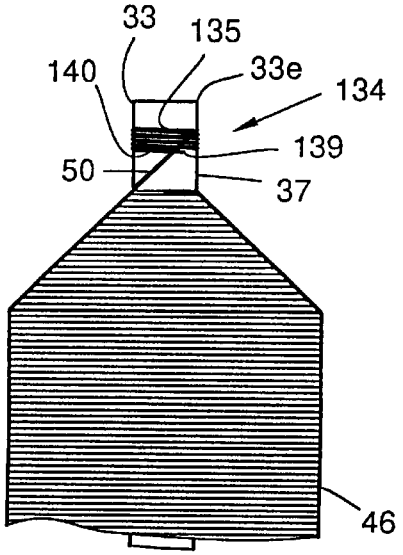
FIG. 5 depicts the structure of a top winding on a spinning cop whose yarn body has been rewound from a spinning pot in accordance with FIG. 4.

The exemplary embodiment in accordance with FIGS. 4 and 5 depicts a yarn deposit 134 for forming a top winding on the cop tube whose structure differs from the structure of the previously described yarn deposit 34 to the extent that it is wound away from the spinning cake 15 toward the upper edge 13*r* of the spinning pot 13. To accomplish such winding 134 the yarn guide 9 is moved in the direction of the arrow 47 into the spinning pot 13 as far as the area 36 above the area for build-up of the spinning cake 15. Spinning is started and the starting end 139 of the yarn is deposited on the inside 13*i* of the spinning pot 13. Once the deposition of the first yarn winding 140 is started, the yarn guide 9 is lifted in the direction of the arrow 48 in order to deposit the few windings 135 of the yarn deposit 134. Thereafter, the yarn guide 39 is briskly lowered in the direction of the arrow 49, so that a segment of yarn 50 is placed over the windings 135. After the mouth 12 of the yarn guide 9 has traveled the distance 37 between the yarn deposit 134 and the location for the spinning cake 15, the build-up of the spinning cake 15 is started by means of a traversing movement 52 superimposed on the downward movement 51 of the yarn guide 9.

As shown in FIG. 5, when the spinning cake 15 is rewound onto an empty tube 33, a yarn body 46 is created on the tube 33. The top winding 134 in this case differs from the top winding 34 of the previous exemplary embodiment in that the starting free end 139 of the yarn is disposed adjacent the yarn body 46 and the windings 135 extend in the direction toward the tube end 33*e*. As a result, the windings 135 are wound on top of the yarn segment 50 extending as far as the tube end 33*e*.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of producing a spinning cop in a pot spinning machine, comprising:

depositing yarn from a yarn guide onto an upper location of an interior of a spinning pot of the pot spinning machine to form an upper yarn deposit in the upper location;

further depositing yarn from the yarn guide onto an area of the interior of the spinning pot spaced from the upper location to form a spinning cake spaced from the upper yarn deposit;

rewinding the spinning cake onto a tube to form a spinning cop; and rewinding the upper yarn deposit onto the tube to form a top winding.

2. The method in accordance with claim 1, further comprising moving the yarn guide in one direction without traversing movement during said depositing of yarn to form the upper yarn deposit; and moving the yarn guide in one direction with traversing movement during said depositing of yarn to form the spinning cake.

3. The method in accordance with claim 1, wherein said depositing of yarn to form the upper yarn deposit includes placing yarn windings in parallel relation with respect to each other in the spinning pot.

4. The method in accordance with claim 3, wherein said depositing of yarn to form the upper yarn deposit includes depositing yarn having a coarser yarn size than that of the yarn deposited in said step of depositing yarn to form the spinning cake.

5. The method in accordance with claim 3, further comprising moving the yarn guide in one direction without traversing movement during said depositing of yarn to form the upper yarn deposit; and moving the yarn guide in one direction with traversing movement during said depositing of yarn to form the spinning cake.

6. The method in accordance with claim 1, wherein said depositing of yarn to form the upper yarn deposit includes depositing yarn having a coarser yarn size than that of the yarn deposited in said step of depositing yarn to form the spinning cake.

7. The method in accordance with claim 6, further comprising moving the yarn guide in one direction without traversing movement during said depositing of yarn to form the upper yarn deposit; and moving the yarn guide in one direction with traversing movement during said depositing of yarn to form the spinning cake.

8. The method in accordance with claim 7, wherein said depositing of yarn to form the upper yarn deposit includes placing yarn windings in parallel relation with respect to each other in the spinning pot.

9. A method of producing a spinning cop in a pot spinning machine, comprising:

depositing yarn from a yarn guide onto an upper location of an interior of a spinning pot of the pot spinning machine to form an upper yarn deposit in the upper location while moving the yarn guide in one direction without traversing movement;

depositing yarn from the yarn guide onto an area of the interior of the spinning pot to form a spinning cake while moving the yarn guide in one direction with traversing movement;

rewinding the spinning cake onto a tube to form a spinning cop; and rewinding the upper yarn deposit onto the tube to form a top winding.

10. The method in accordance with claim 9, wherein said depositing of yarn to form the upper yarn deposit includes placing yarn windings in parallel relation with respect to each other in the spinning pot.

11. A method of producing a spinning cop in a pot spinning machine, comprising:

depositing yarn have a first coarse yarn size from a yarn guide onto an upper location of an interior of a spinning pot of the pot spinning machine to form an upper yarn deposit in the upper location;

depositing yarn having a coarse yarn size less than the first coarse yarn size from the yarn guide onto an area of the interior of the spinning pot to form a spinning cake;

rewinding the spinning cake onto a tube to form a spinning cop; and rewinding the upper yarn deposit onto the tube to form a top winding.

12. The method in accordance with claim 11, wherein said depositing of yarn to form the upper yarn deposit includes placing yarn windings in parallel relation with respect to each other in the spinning pot.

13. The method of claim 11, further comprising moving the yarn guide in one direction without traversing movement during said depositing of yarn to form the upper yarn deposit; and moving the yarn guide in one direction with traversing movement during said depositing of yarn to form the spinning cake.

* * * * *